US009121001B2

(12) United States Patent
Tantawy et al.

(10) Patent No.: US 9,121,001 B2
(45) Date of Patent: Sep. 1, 2015

(54) LAUNDRY DETERGENT COMPOSITIONS

(71) Applicant: The Procter & Gamble Company, Cincinnati, OH (US)

(72) Inventors: Hossam Hassan Tantawy, Northumberland (GB); Andres Arturo Martinez-Guzman, Newcastle upon Tyne (GB); Nigel Patrick Somerville-Roberts, Newcastle upon Tyne (GB); Alan Thomas Brooker, Newcastle upon Tyne (GB); David James Parmley, Gateshead (GB); Victor Stuart Reid, Newcastle upon Tyne (GB); Colin Ure, Tyne & Wear (GB); Carly Pickering, Tyne & Wear (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/905,161

(22) Filed: May 30, 2013

(65) Prior Publication Data

US 2013/0324454 A1 Dec. 5, 2013

(30) Foreign Application Priority Data

Jun. 1, 2012 (EP) ..... 12170466
Feb. 12, 2013 (EP) ..... 13154989

(51) Int. Cl.

| | |
|---|---|
| ***C11D 17/06*** | (2006.01) |
| ***C11D 11/00*** | (2006.01) |
| ***C11D 11/02*** | (2006.01) |
| ***C11D 1/12*** | (2006.01) |
| ***C11D 3/08*** | (2006.01) |
| ***C11D 3/10*** | (2006.01) |
| ***C11D 3/42*** | (2006.01) |
| ***C11D 3/04*** | (2006.01) |

(52) U.S. Cl.

CPC ..... *C11D 17/06* (2013.01); *C11D 3/046* (2013.01); *C11D 11/0082* (2013.01); *C11D 11/02* (2013.01)

(58) Field of Classification Search

USPC ..... 510/438, 443, 444, 452, 276, 475
See application file for complete search history.

(56) References Cited

U.S. PATENT DOCUMENTS

| | | | | |
|---|---|---|---|---|
| 4,820,441 | A * | 4/1989 | Evans et al. | 510/452 |
| 5,009,804 | A * | 4/1991 | Clayton et al. | 510/299 |
| 5,225,100 | A * | 7/1993 | Fry et al. | 510/298 |
| 5,529,710 | A * | 6/1996 | Van Dijk et al. | 510/404 |
| 6,143,711 | A | 11/2000 | DelGreco et al. | |
| 6,191,095 | B1 * | 2/2001 | Emery et al. | 510/438 |
| 6,221,831 | B1 * | 4/2001 | Emery et al. | 510/438 |
| 6,908,895 | B2 | 6/2005 | Bakker et al. | |
| 7,446,085 | B2 | 11/2008 | Imaizumi et al. | |
| 7,605,116 | B2 * | 10/2009 | Brooker et al. | 510/351 |
| 2001/0021719 | A1 * | 9/2001 | Miller et al. | 514/415 |
| 2003/0203832 | A1 | 10/2003 | Boucher et al. | |
| 2006/0035802 | A1 * | 2/2006 | Brooker et al. | 510/445 |
| 2007/0042927 | A1 * | 2/2007 | Muller et al. | 510/444 |
| 2007/0042932 | A1 * | 2/2007 | Appleby et al. | 510/447 |
| 2009/0325844 | A1 | 12/2009 | Tantawy et al. | |
| 2011/0146099 | A1 * | 6/2011 | Cardozo et al. | 34/339 |

FOREIGN PATENT DOCUMENTS

WO WO 2010/024468 A1 * 3/2010

OTHER PUBLICATIONS

PCT Search Report, PCT/US2013/043268, dated Jul. 25, 2013, containing 11 pages.

* cited by examiner

*Primary Examiner* — Lorna M Douyon
(74) *Attorney, Agent, or Firm* — John T. Dipre; Steven W. Miller

(57) ABSTRACT

The present invention is to a laundry detergent powder comprising: (i) from 20 to 80 wt % of a first particle comprising less than 55 wt % sulphate, anionic detersive surfactant, and having a bulk density of from 300 g/l to 1100 g/l: and (ii) from 20 to 80 wt % of a second particle comprising at least 55 wt % sulphate and, having a bulk density of from 350 g/l to 600 g/l, and a process to making the laundry detergent powder.

16 Claims, No Drawings

LAUNDRY DETERGENT COMPOSITIONS

FIELD OF THE INVENTION

The present invention relates to a laundry detergent powder composition and a process for making the laundry detergent powder composition.

BACKGROUND OF THE INVENTION

Particulate detergent compositions comprise detersive active ingredients. Oftentimes these detersive ingredients make the particles 'sticky'. This has the effect of making the particles stick together which negatively impacts the flowability of the granular composition and can affect the dissolution in the wash liquor. Therefore, a 'bulking agent' in the form of a separate particle or powder is often added to the granular composition to counteract the stickiness and maintain good flowability.

Bulking agents include, sulphates, carbonates, silicates, clays (such as bentonite clay), and zeolite. However, carbonates and silicates affect the pH of the wash liquor, making it alkaline and so affecting the cleaning performance of the detergent components. Zeolite is a detergent builder and so interacts with ions in the water that are the source of water hardness. Thus it forms residues of these complexes that deposit on fabrics. Clays result in fabric greying, fabric colour fading and residue deposition on the fabrics.

The most preferred bulking agent is sulphate, as this is pH neutral, and does not act as a builder. However, upon addition to water, sulphate rapidly sinks and forms a sediment at the bottom of the container. Consumers associate this sedimentation with 'poor cleaning' as they believe that the composition is not dissolving into the water and so 'not working'. Furthermore, in a fabric hand washing context, the slowly dissolving sediment makes the wash liquor feel 'gritty'. Consumers associate this with 'dirty wash water' and 'lack of cleaning'. In addition, as the slowly dissolving sulphate sediments in the wash liquor, it can trap other detergent components and so affect the overall cleaning performance.

Thus, there is a need in the art for a granular laundry detergent composition that at least in part overcomes the above mentioned problems but still exhibits excellent flowability.

The Inventors have surprisingly found that a laundry detergent powder comprising (i) from 20 to 80 wt % of a first particle comprising less than 55 wt % sulphate, anionic detersive surfactant, and having a bulk density of from 300 g/l to 1100 g/l and (ii) from 20 to 80 wt % of a second particle comprising at least 55 wt % sulphate, and having a bulk density of from 350 g/l to 600 g/l overcame this issue. It was further surprisingly found that providing the sulphate in a second particle according to the present invention improved the ability to formulate the sulphate into a final consumer product.

SUMMARY OF THE INVENTION

A first aspect of the present invention is to a laundry detergent powder comprising:

(i) from 20 to 80 wt % of a first particle comprising less than 55 wt % sulphate, anionic detersive surfactant, and having a bulk density of from 300 g/l to 1100 g/l: and (ii) from 20 to 80 wt % of a second particle comprising at least 45 wt % sulphate, and having a bulk density of from 350 g/l to 600 g/l.

A second aspect of the present invention is to a process for making a laundry detergent powder according to the first aspect.

DETAILED DESCRIPTION OF THE INVENTION

The Laundry Detergent Powder

The laundry detergent powder of the present invention comprises: (i) from 20 to 80 wt % of a first particle comprising less than 55 wt % sulphate, anionic detersive surfactant, and having a bulk density of from 300 g/l to 1100 g/l: and (ii) from 20 to 80 wt % of a second particle comprising at least 55 wt % sulphate, and having a bulk density of from 350 g/l to 600 g/l.

The first particle can comprise from 50 wt % to 80 wt %, or even from 60 wt % to 80 wt % by weight of the laundry detergent powder. The second particle can comprise from 20 wt % to 50 wt % by weight of the laundry detergent powder.

The laundry detergent powder is suitable for any laundry detergent application, for example: laundry, including automatic washing machine laundering and hand laundering, and even bleach and laundry additives.

The laundry detergent powder can be a fully formulated detergent product, such as a fully formulated laundry detergent product, or it can be combined with other particles to form a fully formulated detergent product, such as a fully formulated laundry detergent product. The first and second laundry detergent particles may be combined with other particles such as: enzyme particles; perfume particles including agglomerates or extrudates of perfume microcapsules, and perfume encapsulates such as starch encapsulated perfume accord particles; surfactant particles, such as non-ionic detersive surfactant particles including agglomerates or extrudates, anionic detersive surfactant particles including agglomerates and extrudates, and cationic detersive surfactant particles including agglomerates and extrudates; polymer particles including soil release polymer particles, cellulosic polymer particles; buffer particles including carbonate salt and/or silicate salt particles, preferably a particle comprising carbonate salt and silicate salt such as a sodium carbonate and sodium silicate co-particle, and particles and sodium bicarbonate; other spray-dried particles; fluorescent whitening particles; aesthetic particles such as coloured noodles or needles or lamellae particles; bleaching particles such as percarbonate particles, especially coated percarbonate particles, including carbonate and/or sulphate coated percarbonate, silicate coated percarbonate, borosilicate coated percarbonate, sodium perborate coated percarbonate; bleach catalyst particles, such as transition metal catalyst bleach particles, and imine bleach boosting particles; performed peracid particles; hueing dye particles; and any mixture thereof.

It may also be especially preferred for the laundry detergent powder to comprise low levels, or even be essentially free, of builder. By essentially free of it is typically meant herein to mean: "comprises no deliberately added". In a preferred embodiment, the laundry detergent powder comprises no builder.

The laundry detergent powder is typically flowable, typically having a cake strength of from 0 N to 20 N, preferably from 0 N to 15 N, more preferably from 0 N to 10 N, most preferably from 0 N to 5 N. The method to determine the cake strength is described in more detail elsewhere in the description.

The laundry detergent powder comprises a first particle and a second particle. By first and second particles, we herein mean that the laundry detergent powder comprises two distinct particle types, the first particle being formed independently of the second particle. The first particle has a different intra-particulate chemistry to that of the second particle.

The laundry detergent powder typically comprises from 0 wt % to 7 wt %, preferably from 1 wt % to 5 wt %, and preferably from 2 wt % to 3 wt % water.

First Particle

The first particle comprises less than 55 wt % sulphate, anionic detersive surfactant, and has a bulk density of from 300 g/l to 1100 g/l.

The first particle may have a bulk density of from 300 g/l to 900 g/l, or even from 700 g/l to 1100 g/l.

In a preferred embodiment, the first particle comprises from 0 to 5 wt %, preferably from 1.5 to 3 wt % polymer. Without wishing to be bound by theory, the presence of the polymer can act to decrease the 'stickiness' of the first particle. This has benefits on the flowability of the spray-dried powder. In one embodiment, the first particle comprises at least one polymer, or even at least two polymers, or even at least three polymers. The polymer in the first particle can be selected from a polycarboxylate homopolymer or a polycarboxylate copolymer, preferably the polymer is selected from polyacrylate homopolymer or acrylic acid/maleic acid copolymer.

The first particle may comprise cellulosic polymer, preferably selected from alkyl cellulose, alkyl alkoxyalkyl cellulose, carboxylalkyl cellulose, alkyl carboxyalkyl, more preferably selected from carboxymethyl cellulose (CMC) including blocky CMC, methyl cellulose, methyl hydroxyethyl cellulose, methyl carboxymethyl cellulose, and mixtures thereof. Other suitable polymers are described in more detail below.

The first particle may comprise at least 5 wt %, or at least 10 wt %, or at least 15 wt %, or at least 30 wt % anionic detersive surfactant. The first particle may comprise at most 50 wt %, or at most 40 wt %, or at most 30 wt %, or at most 20 wt % anionic detersive surfactant. Suitable anionic detersive surfactants are described in more detail below. The anionic detersive surfactant can be alkyl benzene sulphonic acid or salt thereof, alkyl ethoxylated sulphate, or a mixture thereof. Preferably, the anionic detersive surfactant is a mixture of alkyl benzene sulphonic acid or salt thereof and alkyl ethoxylated sulphate.

The sulphate is described in more detail below.

The first particle may comprise from 0-20 wt % silicate, or 1-15 wt % silicate.

The first particle may comprise between 0 wt % and 50 wt % carbonate, or between 10 wt % and 40 wt % carbonate, or between 15 wt % and 40 wt % carbonate. The first particle may comprise between 0 wt % and 30 wt %, or at most 20 wt %, or even at most 10 wt %.

The first particle may comprise HEDP, brighteners or a mixture thereof. Brighteners are described in more detail below.

The first particle may have a mean particle size of between 350 and 500 μm, preferably between 375 and 425 μm. The first particle may have a mean particle size of between 350 and 650 μm, preferably between 375 and 500 μm.

The first particle may be an agglomerate particle, an extrudate, a spray-dried particle or a flash-dried particle. The first particle may be a spray-dried particle. Alternatively, the first particle may be an agglomerate particle. Without wishing to be bound by theory, it is preferred to agglomerate the first particle. This is because the first particle comprises components that require longer drying times, for example, anionic detersive surfactant. If the particle is spray-dried for example, there may not be enough time for the particle to completely dry before it exists the spray-dry tower. These 'wet' particles have negative effects such as causing caking and so affect the flowability of the powder. Increasing the spray-dry temperature can result in over-heating of heat sensitive components within the particle. Agglomeration allows for a longer drying time, allowing the particles to fully dry and also minimizing the over-heating of heat sensitive components.

Second Spray-Dried Particle

The second particle comprises at least 55 wt % sulphate and from 0 wt % to 15 wt % anionic detersive surfactant and has a bulk density of from 350 g/l to 600 g/1.

The sulphate is described in more detail below. The second particle may comprise at least 55 wt %, or even 65 wt % or even 75 wt % sulphate. The second particle may comprise at most 99 wt % sulphate, or even 90 wt %, or even 85 wt % or even 80 wt % sulphate.

The second particle may comprise carbonate. If carbonate is present in the second particle, it may be present at a concentration of between 0 wt % and 30 wt %, or at most 20 wt %, or even at most 10 wt %. Carbonate may be present in the second particle at a concentration of at least 1 wt %, or even 2 wt %, or even 5 wt % or even 10 wt %, or even 15 wt %.

The second particle may comprise polymer, preferably from 0 to 10 wt % polymer, or even from 1 wt % to 8 wt % polymer. Suitable polymers are described in more detail below. The polymer in the second particle can be selected from a polycarboxylate homopolymer or a polycarboxylate copolymer, preferably the polymer is selected from polyacrylate homopolymer or acrylic acid/maleic acid copolymer.

The second particle may comprise 0-15 wt %, or even 1-12 wt %, or 2-10 wt % anionic detersive surfactant. Suitable anionic detersive surfactants are described in more detail below. The anionic detersive surfactant in the second particle can be linear alkylbenzene sulfonate. Or the anionic detersive surfactant in the second particle can be alkyl ethoxylated sulphate.

The second particle may comprise from 0 to 10 wt % silicate.

The second particle may have a mean particle size of between 350 and 650 μm, preferably between 350 and 500 μm, more preferably between 375 and 500 μm.

Without wishing to be bound by theory, the density of the second particle means that it floats in the wash liquor and exhibits reduced sedimentation. The density of the second particle is lower than traditionally used sulphate particles. This is preferably achieved by spray-drying or flash-drying the second particle. During the spray-drying or flash-drying process, preferably air is injected into the aqueous slurry which is then spray-dried or flash-dried to produce the second particle. This results in 'air bubbles' in the particle. This increased porosity means that the particle has a higher surface area, and so the particle dissolves faster in the wash liquor. This faster dissolution and lower level of sedimentation means that the wash liquor does not have the same gritty feel as if traditional sulphate particles were used. However, the sulphate (second) particle still acts as a bulking agent ensuring excellent flowability of the powder composition.

The second particle may be a spray-dried particle, a flash-dried particle, an agglomerate particle, or an extrudate. Preferably, the second particle is a spray-dried particle.

The bulk density of the second particle can be from 350 g/l to 700 g/l, or from 400 g/l to 550 g/l.

Sulphate

The sulphate in the first spray-dried particle and independently in the second spray-dried particle can be any suitable sulphate.

Polymer

The polymer in the first particle and independently in second particle can be any suitable polymer.

Suitable polymers include carboxylate polymers, such as polyacrylates, and acrylate/maleic co-polymers and other functionalized polymers such as styrene acrylates. Preferably, the carboxylate polymer is an acrylate/maleic copolymer having an average molecular weight of about 2,000 to about 100,000 and a ratio of acrylate to maleate segments of from about 30:1 to about 1:1.

One suitable polymer is an amphiphilic graft polymer (AGP). Suitable AGPs are obtainable by grafting a polyalkylene oxide of number average molecular weight from about 2,000 to about 100,000 with vinyl acetate, which may be partially saponified, in a weight ratio of polyalkylene oxide to vinyl acetate of about 1:0.2 to about 1:10. The vinyl acetate may, for example, be saponified to an extent of up to 15%. The polyalkylene oxide may contain units of ethylene oxide, propylene oxide and/or butylene oxide. Selected embodiments comprise ethylene oxide.

In some embodiments the polyalkylene oxide has a number average molecular weight of from about 4,000 to about 50,000, and the weight ratio of polyalkylene oxide to vinyl acetate is from about 1:0.5 to about 1:6. A material within this definition, based on polyethylene oxide of molecular weight 6,000 (equivalent to 136 ethylene oxide units), containing approximately 3 parts by weight of vinyl acetate units per 1 part by weight of polyethylene oxide, and having itself a molecular weight of about 24,000, is commercially available from BASF as Sokalan HP22.

Suitable AGPs may be present in the detergent composition at weight percentages of from about 0% to about 5%, preferably from about above 0% to about 4%, or from about 0.5% to about 2%. In some embodiments, the AGP is present at greater than about 1.5 wt %. The AGPs are found to provide excellent hydrophobic soil suspension even in the presence of cationic coacervating polymers.

Preferred AGPs are based on water-soluble polyalkylene oxides as a graft base and side chains formed by polymerization of a vinyl ester component. These polymers having an average of less than or equal to one graft site per 50 alkylene oxide units and mean molar masses (Mw) of from about 3000 to about 100,000.

Another suitable polymer is polyethylene oxide, preferably substituted or un-substituted.

Another suitable polymer is cellulosic polymer, preferably selected from alkyl cellulose, alkyl alkoxyalkyl cellulose, carboxylalkyl cellulose, alkyl carboxyalkyl, more preferably selected from carboxymethyl cellulose (CMC) including blocky CMC, methyl cellulose, methyl hydroxyethyl cellulose, methyl carboxymethyl cellulose, and mixtures thereof.

Other suitable polymers are soil release polymers. Suitable polymers include polyester soil release polymers. Other suitable polymers include terephthalate polymers, polyurethanes, and mixtures thereof. The soil release polymers, such as terephthalate and polyurethane polymers can be hydrophobically modified, for example to give additional benefits such as sudsing.

Other suitable polymers include polyamines, preferably polyethylene imine polymers, preferably having ethylene oxide and/or propylene oxide functionalized blocks Other suitable polymers include synthetic amino containing amphoteric/and/or zwitterionic polymers, such as those derived from hexamethylene diamine.

Another suitable polymer is a polymer that can be co-micellized by surfactants, such as the AGP described in more detail above.

Other suitable polymers include silicone, including amino-functionalised silicone.

Suitable polymers can include clay and soil removal/anti-redeposition agents being co-polymers comprising:

(i) from 50 to less than 98 wt % structural units derived from one or more monomers comprising carboxyl groups; (ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (I) and (II):

formula (I)

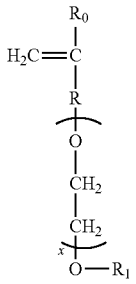

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

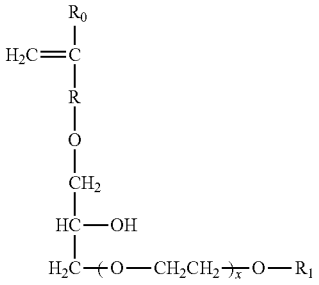

in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

Other suitable polymers include polysaccharide polymers such as celluloses, starches, lignins, hemicellulose, and mixtures thereof.

Other suitable polymers include cationic polymers, such as deposition aid polymers, such as cationically modified cellulose such as cationic hydroxy ethylene cellulose, cationic guar gum, cationic starch, cationic acrylamides and mixtures thereof.

Mixtures of any of the above described polymers can be used herein.

Anionic Detersive Surfactant

The anionic detersive surfactant can be alkyl benzene sulphonic acid or salt thereof, alkyl ethoxylated sulphate, or a mixture thereof. Preferably, the anionic detersive surfactant is a mixture of alkyl benzene sulphonic acid or salt thereof and alkyl ethoxylated sulphate.

Suitable anionic detersive surfactants include sulphate and sulphonate detersive surfactants.

Preferred sulphonate detersive surfactants include alkyl benzene sulphonate, preferably $C_{10-13}$ alkyl benzene sulphonate. Suitable alkyl benzene sulphonate (LAS) is obtainable, preferably obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable.

Preferred sulphate detersive surfactants include alkyl sulphate, preferably $C_{8-18}$ alkyl sulphate, or predominantly $C_{12}$ alkyl sulphate.

Another preferred sulphate detersive surfactant is alkyl alkoxylated sulphate, preferably alkyl ethoxylated sulphate, preferably a $C_{8-18}$ alkyl alkoxylated sulphate, preferably a $C_{8-18}$ alkyl ethoxylated sulphate, preferably the alkyl alkoxylated sulphate has an average degree of alkoxylation of from 0.5 to 20, preferably from 0.5 to 10, preferably the alkyl alkoxylated sulphate is a $C_{8-18}$ alkyl ethoxylated sulphate having an average degree of ethoxylation of from 0.5 to 10, preferably from 0.5 to 7, more preferably from 0.5 to 5 and most preferably from 0.5 to 3.

The alkyl sulphate, alkyl alkoxylated sulphate and alkyl benzene sulphonates may be linear or branched, substituted or un-substituted.

Brightener

Suitable brighteners are stilbenes, such as brightener 15. Other suitable brighteners are hydrophobic brighteners, and brightener 49. The brightener may be in micronized particulate form, having a weight average particle size in the range of from 3 to 30 micrometers, or from 3 micrometers to 20 micrometers, or from 3 to 10 micrometers. The brightener can be alpha or beta crystalline form.

The detergent composition preferably comprises C.I. fluorescent brightener 260 in alpha-crystalline form having the following structure:

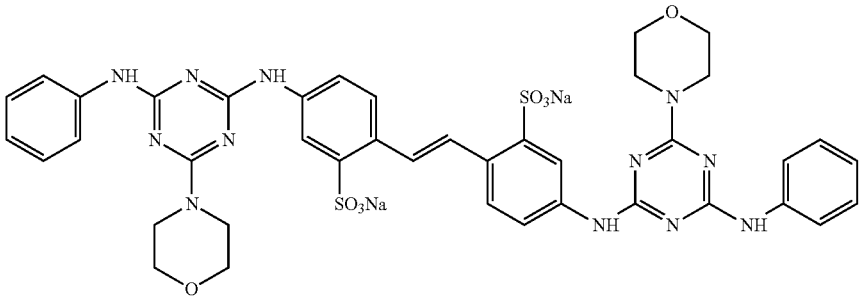

The C.I. fluorescent brightener 260 is preferably predominantly in alpha-crystalline form. Predominantly in alpha-crystalline form means that preferably at least 50 wt %, or at least 75 wt %, or even at least 90 wt %, or at least 99 wt %, or even substantially all, of the C.I. fluorescent brightener 260 is in alpha-crystalline form.

The brightener is typically in micronized particulate form, having a weight average primary particle size of from 3 to 30 micrometers, preferably from 3 micrometers to 20 micrometers, and most preferably from 3 to 10 micrometers.

The detergent composition may comprises C.I. fluorescent brightener 260 in beta-crystalline form, and preferably the weight ratio of: (i) C.I. fluorescent brightener 260 in alpha-crystalline form, to (ii) C.I. fluorescent brightener 260 in beta-crystalline form is at least 0.1, preferably at least 0.6.

BE680847 relates to a process for making C.I fluorescent brightener 260 in alpha-crystalline form.

Zeolite Builder

Suitable zeolite builder includes include zeolite A, zeolite P and zeolite MAP. Especially suitable is zeolite 4A.

Phosphate Builder

A typical phosphate builder is sodium tri-polyphosphate.

Silicate Salt

A suitable silicate salt is sodium silicate, preferably 1.6 R and/or 2.0 R sodium silicate.

Other Detergent Ingredients

The composition typically comprises other detergent ingredients. Suitable detergent ingredients include: transition metal catalysts; imine bleach boosters; enzymes such as amylases, carbohydrases, cellulases, laccases, lipases, bleaching enzymes such as oxidases and peroxidases, proteases, pectate lyases and mannanases; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; suds suppressing systems such as silicone based suds suppressors; brighteners; hueing agents; photobleach; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as oligomers produced by the condensation of imidazole and epichlorhydrin; soil dispersants and soil anti-redeposition aids such as alkoxylated polyamines and ethoxylated ethyleneimine polymers; anti-redeposition components such as polyesters and/or terephthalate polymers, polyethylene glycol including polyethylene glycol substituted with vinyl alcohol and/or vinyl acetate pendant groups; perfumes such as perfume microcapsules, polymer assisted perfume delivery systems including Schiff base perfume/polymer complexes, starch encapsulated perfume accords; soap rings; aesthetic particles including coloured noodles and/or needles; dyes; fillers such as sodium sulphate, although it may be preferred for the composition to be substantially free of fillers; carbonate salt including sodium carbonate and/or sodium bicarbonate; silicate salt such as sodium silicate, including 1.6 R and 2.0 R sodium silicate, or sodium metasilicate; co-polyesters of di-carboxylic acids and diols; cellulosic polymers such as methyl cellulose, carboxymethyl cellulose, hydroxyethoxycellulose, or other alkyl or alkylalkoxy cellulose, and hydrophobically modified cellulose; carboxylic acid and/or salts thereof, including citric acid and/or sodium citrate; and any combination thereof.

Method for Measuring Cake Strength

A smooth plastic cylinder of internal diameter 6.35 cm and length 15.9 cm is supported on a suitable base plate. A 0.65 cm hole is drilled through the cylinder with the centre of the hole being 9.2 cm from the end opposite the base plate.

A metal pin is inserted through the hole and a smooth plastic sleeve of internal diameter 6.35 cm and length 15.25 cm is placed around the inner cylinder such that the sleeve can move freely up and down the cylinder and comes to rest on the metal pin. The space inside the sleeve is then filled (without tapping or excessive vibration) with the spray-dried powder such that the spray-dried powder is level with the top of the sleeve. A lid is placed on top of the sleeve and a 5 kg weight placed on the lid. The pin is then pulled out and the spray-dried powder is allowed to compact for 2 minutes. After 2 minutes the weight is removed, the sleeve is lowered to expose the powder cake with the lid remaining on top of the powder.

A metal probe is then lowered at 54 cm/min such that it contacts the centre of the lid and breaks the cake. The maximum force required to break the cake is recorded and is the result of the test. A cake strength of 0 N refers to the situation where no cake is formed.

Process to Make the Laundry Detergent Powder

Another aspect of the present invention is a method for making the laundry detergent powder according to the present invention, comprising the steps of;

a) agglomerating the sulphate and anionic detersive surfactant to make the first particle;
b) preparing an aqueous slurry comprising sulphate and drying the aqueous slurry by spray-drying or flash-drying;
c) combining the first and second particles to produce the laundry detergent powder.

Step (a):

is preferably carried out in a mechanical mixer, such as paddle mixer, or a CB lodige, KM lodige, Schugi mixer. Preferably step (a) is carried out in a paddle mixer. In a preferred embodiment all components are added to the mechanical mixer and are agglomerated together. Polymer, carbonate, silicate or a mixture thereof may also be agglomerated with the sulphate and anionic detersive surfactant. Alternatively, in step a), the first particle may be prepared by sprya-drying or flash-drying following the same process as used to make the second particle (see below). Preferably, the sulphate added in step (a) has a volume average particle size of from 10 micrometers to 50 micrometers, preferably from 20 micrometers, or from 30 micrometers, and preferably to 45 micrometers, or even to 42 micrometers.

Step (b):

the aqueous slurry may also comprise polymer, silicate, carbonate or a mixture thereof. A preferred method for making the second particle is via a spray-drying process comprising the steps of;

i. preparing an aqueous slurry comprising sulphate, optionally silicate, optionally polymer, optionally anionic surfactant and water;
ii. spraying the aqueous slurry through a spray nozzle into a spray-drying tower; and
iii. spray-drying the mixture to form the first particle.

Step (i):

the aqueous slurry can be formed by mixing in any suitable vessel, such as a mixer, in the standard manner. Suitable mixers include vertical mixers, slurry mixers, tank agitators, crutcher mixers and the like.

Step (ii):

the aqueous slurry is transferred from the mixer, preferably through at least one pump, to a spray nozzle. Typically, the aqueous slurry is transferred in a pipe. The aqueous slurry is typically transferred though an intermediate storage vessel such as a drop tank, for example when the process is semi-continuous. Alternatively, the process can be a continuous process, in which case no intermediate storage vessel is required. The aqueous slurry is transferred through at least one pump, preferably at least two, or even at least three or more pumps, although one or two, preferably two pumps may be preferred. Typically, when two or more pumps are used, the first pump is a low pressure pump, such as a pump that is capable of generating a pressure of from $3\times10^5$ to $1\times10^6$ Pa, and the second pump is a high pressure pump, such as a pump that is capable of generating a pressure of from $2\times10^6$ to $1\times10^7$ Pa. Optionally, the aqueous slurry is transferred through a disintegrator, such as disintegrators supplied by Hosakawa Micron. The disintegrator can be positioned before the pump, or after the pump. If two or more pumps are present, then the disintegrator can also be positioned between the pumps. Typically, the pumps, disintegrators, intermediate storage vessels, if present, are all in series configuration. However, some equipment may be in a parallel configuration. A suitable spray nozzle is a Spray Systems T4 Nozzle.

In a preferred embodiment, the aqueous slurry is prepared by mixing the anionic surfactant, the sulphate and the water to form an aqueous premix, the aqueous premix is pumped through a pipe to the spray nozzle, the silicate and polymer are independently injected into the pipe before the spray nozzle. The premix can be formed by mixing in any suitable vessel, such as a mixer, in the standard manner. Suitable mixers include vertical mixers, slurry mixers, tank agitators, crutcher mixers and the like.

The independent injection of the silicate and the polymer can be carried out in any position after the mixer and before the spray nozzle. However, preferably injection is carried out after the premix has been transferred through at least one pump, although injection can be carried out before the premix has been transferred through at least one pump. In a preferred embodiment, the premix is transferred through at least two pumps, and injection is carried out after the premix has been transferred through the first pump but before the premix enters the second pump. Preferably, during step (b) the pipe carrying the aqueous slurry and premix is at a pressure between $3\times10^5$ and $1\times10^6$ Pa.

In step (b), it may be preferred that additionally sodium chloride is contacted to the aqueous slurry after the mixer and before the spray nozzle.

A nitrogen-rich gas, preferably air, may be injected into the aqueous slurry before the spray nozzle. Preferably, the nitrogen-rich gas is injected into the aqueous slurry between the first pump and the second pump. By 'nitrogen-rich gas' we herein mean a gas comprising at least 50 wt % nitrogen. By 'air' we herein mean atmospheric air.

The aqueous slurry is sprayed through the spray nozzle into a spray-drying tower. Preferably, the aqueous slurry is at a temperature of from 60° C. to 130° C. when it is sprayed through the spray nozzle into the spray-drying tower. Suitable spray-drying towers are co-current or counter-current spray-drying towers. The slurry is typically sprayed at a pressure of from $6\times10^6$ Pa to $1\times10^7$ Pa.

Preferably when added to the aqueous slurry, the sulphate has a volume average particle size of from 10 micrometers to 50 micrometers, preferably from 20 micrometers, or from 30 micrometers, and preferably to 45 micrometers, or even to 42 micrometers. The volume average particle size of the sulphate can be determined by any conventional means, such as light scattering, for example using a sympatec particle size analyser. The particle size of the inorganic salt can be controlled (i.e. reduced) by any suitable means, such as dry grinding (e.g. using pin mills) or wet grinding (e.g. using colloid mill). Without wishing to be bound by theory, smaller particle size sulphate dissolves more efficiently into the aqueous slurry. It is believed this is due to the larger surface area of the sulphate particles. This improved efficiency of dissolution has the benefit that less sulphate sediments out of the slurry during the manufacturing process. Sedimentation can cause blockages in the apparatus and so negatively affect production. Furthermore, the smaller particle size of the sulphate in the resultant spray-dried particle has the benefit of further reducing the 'gritty' feel within the wash liquor.

Step (iii):

The slurry is spray-dried to form a spray-dried powder. Preferably, the exhaust air temperature is in the range of from 60° C. to 100° C. Alternatively, rather than spray-drying, the slurry may be flash-dried.

Step (c):

The first and second particles are mixed together to produce the laundry detergent powder.

A comparison was made between a spray-dried powder according to the present invention and a spray-dried powder outside of the scope of the present claims.

EXAMPLES

A comparison was made between a spray-dried powder according to the present invention and a spray-dried powder outside of the scope of the present claims.

A first detergent powder A was prepared. An aqueous alkaline slurry composed of sodium sulphate, sodium carbonate, water, acrylate/maleate co-polymer and miscellaneous ingredients was prepared at 80° C. in a crutcher making vessel. The aqueous slurry was essentially free from zeolite builder and essentially free from phosphate builder. Alkyl benzene sulphonic acid (HLAS) and sodium hydroxide were added to the aqueous slurry and the slurry was pumped through a standard spray system pressure nozzle and atomized into a counter current spray drying tower at an air inlet temperature of 275° C. The atomized slurry was dried to produce a solid mixture, which was then cooled and sieved to remove oversize material (>1.8 mm) to form a spray-dried powder. The spray-dried powder had a bulk density of 470 g/l.

This spray-dried powder was blended, in a batch rotating mixer, with other ingredient to produce a composition comprising 57.91% spray-dried powder, 13% surfactant agglomerate and 20.45% sodium sulphate. Powder detergent A has a cake strength of 0 N as measured using the method described herein. The overall composition of the POWDER DETERGENT A is shown in Table 1.

TABLE 1

| Component | % w/w POWDER A |
|---|---|
| Sodium silicate salt | 5.7 |
| Linear alkyl benzene sulphonate | 14.5 |
| Acrylate/maleate copolymer | 1.6 |
| Zeolite | 2.7 |
| Sodium carbonate | 12.4 |
| Sodium sulphate | 56.8 |
| Water | 1.5 |
| Miscellaneous, such as dye, clay, perfume and enzymes | 2.7 |
| Total Parts | 100.00 |

A second detergent powder B was prepared comprising and 43 wt % of a first spray dried particle (bulk density: 300 g/l), and 56 wt % of a second spray-dried particle (bulk density: 380 g/l), blended in a batch rotating mixer, with 1% of sodium sulphate and other minor powder additives. The composition of the first dried particle is seen in Table 2 and the second spray-dried particle in Table 3.

TABLE 2

| Component | % w/w |
|---|---|
| Sodium silicate salt | 15.6 |
| Linear alkyl benzene sulphonate | 40.0 |
| Sodium carbonate | 38.5 |
| Water | 2.5 |
| Chelant | 3.4 |
| Total Parts | 100.0 |

TABLE 3

| Component | % w/w |
|---|---|
| Sodium silicate salt | 3.0 |
| Linear alkyl benzene sulphonate | 9.7 |
| Acrylate/maleate copolymer | 9.1 |
| Sodium sulphate | 77.2 |
| Water | 1.0 |
| Total Parts | 100.0 |

The first spray dried particle was manufactured via spray drying of an aqueous alkaline slurry composed of sodium carbonate, anionic surfactant and acrylate polymer. The slurry was prepared at 80° C. in a crutcher making vessel and the slurry was pumped through a standard spray system pressure nozzle and atomized into a counter current spray drying tower at an air inlet temperature of 275° C. The atomized slurry was dried to produce a solid mixture, which was then cooled and sieved to remove oversize material (>1.8 mm) to form a spray-dried powder. The second spray dried particle was manufactured via spray drying of an aqueous slurry composed of sodium sulphate having a particle size of between 10 and 50 microns, water, anionic surfactant and acrylate/maleate co-polymer. The slurry was prepared in at 80° C. in a crutcher making vessel and the slurry was pumped through a standard spray system pressure nozzle and atomized into a counter current spray drying tower at an air inlet temperature of 275° C. The atomized slurry was dried to produce a solid mixture, which was then cooled and sieved to remove oversize material (>1.8 mm) to form a spray-dried powder.

Powder detergent B had a cake strength of 0 N as measured by the method described herein. The overall composition of the POWDER DETERGENT B is shown in Table 4.

TABLE 4

| Component | % w/w POWDER B |
|---|---|
| Sodium silicate salt | 5.6 |
| Linear alkyl benzene sulphonate | 15.8 |
| Acrylate/maleate copolymer | 7.1 |
| Zeolite | 1.0 |
| Sodium carbonate | 8.7 |
| Sodium sulphate | 57.7 |
| Water | 1.3 |
| Miscellaneous, such as dye, clay, perfume and enzymes | 2.8 |
| Total Parts | 100.00 |

Dissolution Test

A 3 g sample of both DETERGENT A and DETERGENT B were separately dispersed into 1 L aliquots of fresh tap water at 20° C., stirred at 200 RPM, using a magnetic stirrer and hotplate with thermocouple. The powders were left to dissolve for 30 seconds and then the dissolutions were decanted and passed through a cotton fabric filter (black cotton fabric, cut in a 9 cm diameter circle). The filters were dried and the mass of the dry filters were recorded before and after the filtration process. The initial and final weights were used to determine the % of undissolved detergent:

$$\%\ \text{undissolved detergent} = \frac{m_{filter\ after\ filtration} - m_{filter\ before\ filtration}}{3\ \text{g}} \times 100$$

The results can be seen in Table 5.

TABLE 5

| | % undissolved detergent |
|---|---|
| Powder Detergent A | 8.62% |
| Powder Detergent B | 5.49% |

As can be seen from Table 5, there was a 36% improvement in fast solubility in Detergent B as compared to Detergent A.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A laundry detergent powder comprising:

(i) from about 20 to about 80 wt % of a first particle comprising less than about 55 wt % sulphate, at least about 30 wt % anionic detersive surfactant, between 15 wt % and about 20 wt % silicate, between about 10 wt % and about 40 wt % carbonate, between about 1.5 wt % and 3 wt % of a first polymer, and wherein the first particle is an agglomerate particle having a bulk density of from about 700 g/l to about 1100 g/l: and (ii) from about 20 to about 80 wt % of a second particle comprising at least about 55 wt % sulphate, between about 1 wt % and about 12 wt % anionic detersive surfactant, between about 1 wt % and about 5 wt % silicate, between about 1 wt % and 8 wt % of a second polymer, and having a bulk density of from about 350 g/l to about 600 g/l;

wherein the first particle and the second particle are both essentially free of zeolite builder and essentially free of phosphate builder, wherein the first and second polymer are selected from the group consisting of a polyacrylate homopolymer and an acrylic acid/maleic acid copolymer.

2. The laundry detergent powder according to claim 1, wherein the second particle is a spray-dried particle or flash-dried particle.

3. The laundry detergent powder according to claim 1, wherein the first particle has a mean particle size of between about 350 and about 650 μm, and the second particle has a mean particle size of between about 350 and about 650 μm.

4. The laundry detergent powder according claim 1, comprising from about 50% to about 80% by weight of the laundry detergent powder of the first particle and from about 20% to about 50% by weight of the laundry detergent powder of the second particle.

5. The laundry detergent powder according to claim 1 wherein the first particle, the second particle or both particles further comprise a co-polymer comprising:

(i) from about 50 to less than about 98 wt % structural units derived from one or more monomers comprising carboxyl groups;

(ii) from about 1 to less than about 49 wt % structural units derived from one or more monomers comprising sulfonate moieties; and (iii) from about 1 to about 49 wt % structural units derived from one or more types of monomers selected from ether bond-containing monomers represented by formulas (I) and (II):

formula (I)

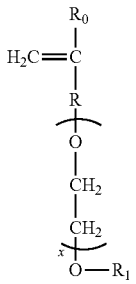

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

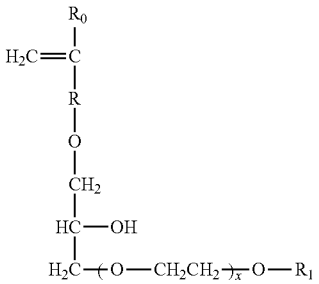

in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

6. The laundry detergent powder according to claim 1, wherein the anionic detersive surfactant in the first particle is linear alkylbenzene sulfonic acid or a salt thereof, alkyl ethoxylated sulphate or a mixture thereof.

7. The laundry detergent powder according to claim 1, wherein the first particle further comprises a cellulosic polymer.

8. The laundry detergent powder according to claim 7, wherein the cellulosic polymer is selected from the group consisting of alkyl cellulose, alkyl alkoxyalkyl cellulose, carboxylalkyl cellulose, alkyl carboxyalkyl cellulose and a mixture thereof.

9. The laundry detergent powder according to claim 1, wherein the first particle further comprises a brightener.

10. A method for making the laundry detergent powder according to claim 1, comprising the steps of:

a) agglomerating the components of part (i) to make the first particle;

b) preparing an aqueous slurry comprising the components of part (ii) and water, and drying the aqueous slurry by spray-drying or flash-drying to make the second particle;

c) combining the first and second particles to produce the laundry detergent powder.

11. The method according to claim 10, wherein the sulphate added to the aqueous slurry in step (b) has a volume average particle size of from about 10 micrometers to about 50 micrometers.

12. The method according to claim 11 wherein the sulphate added to the aqueous slurry in step (b) has a volume average particle size of from about 20 micrometers to about 45 micrometers.

13. The method according to claim 12 wherein the sulphate added to the aqueous slurry in step (b) has a volume average particle size of from about 30 micrometers to about 42 micrometers.

14. The method according to claim 10, wherein the sulphate added in step (a) has a volume average particle size of from about 10 micrometers to about 50 micrometers.

15. The method according to claim 14, wherein the sulphate added in step (a) has a volume average particle size of from about 20 micrometers to about 45 micrometers.

16. The method according to claim 15, wherein the sulphate added in step (a) has a volume average particle size of from about 30 micrometers to about 42 micrometers.

* * * * *